US005398760A

United States Patent [19]

George et al.

[11] Patent Number: 5,398,760

[45] Date of Patent: Mar. 21, 1995

[54] METHODS OF PERFORATING A WELL USING COILED TUBING

[75] Inventors: Flint R. George, Flower Mound; Kevin R. George, Cleburne, both of Tex.

[73] Assignee: Halliburton Company, Houston, Tex.

[21] Appl. No.: 134,022

[22] Filed: Oct. 8, 1993

[51] Int. Cl.[6] ..... E21B 43/116

[52] U.S. Cl. ..... 166/297; 166/385; 166/55

[58] Field of Search ..... 166/297, 385, 55, 125; 175/4.52

[56] References Cited

U.S. PATENT DOCUMENTS

| | | | |
|---|---|---|---|
| 2,192,591 | 3/1940 | Alexander | 164/0.5 |
| 2,749,840 | 6/1956 | Babcock | 102/20 |
| 2,799,224 | 7/1957 | Long | 102/20 |
| 2,853,944 | 9/1958 | Robertson | 102/20 |
| 2,873,675 | 2/1959 | Lebourg | 102/20 |
| 2,876,843 | 3/1959 | Huber | 166/55 |
| 2,906,339 | 9/1959 | Griffin | 166/35 |
| 2,981,185 | 4/1961 | Caldwell | 102/20 |
| 3,032,109 | 5/1962 | Corley, Jr. et al. | 166/55.4 |
| 3,314,478 | 4/1967 | Burns | 166/49 |
| 3,531,236 | 9/1970 | Braddick et al. | 166/285 |
| 3,706,344 | 12/1972 | Vann | 166/297 |
| 3,966,236 | 6/1976 | Vann | 285/39 |
| 4,066,282 | 1/1978 | Vann | 285/39 |
| 4,078,611 | 3/1978 | Vann | 166/297 |
| 4,122,899 | 10/1978 | Brieger | 166/297 |
| 4,355,685 | 10/1982 | Beck | 166/240 |
| 4,526,233 | 7/1985 | Stout | 166/377 |
| 4,557,331 | 12/1985 | Stout | 166/297 |
| 4,614,156 | 9/1986 | Colle, Jr. et al. | 102/312 |
| 4,694,878 | 9/1987 | Gambertoglio | 166/377 |
| 4,771,827 | 9/1988 | Barker et al. | 166/55.1 |
| 4,776,393 | 10/1988 | Forehand et al. | 166/55.1 |
| 4,805,696 | 2/1989 | Henderson | 166/114 |
| 4,815,540 | 3/1989 | Wallbillich, III | 166/377 |
| 4,905,759 | 3/1990 | Wesson et al. | 166/55 |
| 5,025,861 | 6/1991 | Huber et al. | 166/297 |
| 5,050,682 | 9/1991 | Huber et al. | 166/385 X |
| 5,156,213 | 10/1992 | George et al. | 166/297 |
| 5,191,936 | 3/1993 | Edwards et al. | 166/297 |
| 5,293,940 | 3/1994 | Hromas et al. | 166/297 |

FOREIGN PATENT DOCUMENTS

| | | | |
|---|---|---|---|
| 9025166.1 | 11/1990 | United Kingdom . | |
| 2263119 | 7/1993 | United Kingdom | 166/385 |

OTHER PUBLICATIONS

Vann Systems Catalog, pp. 16 and 17, entitled "Pressure Actuated Tubing Release" (not dated but admitted to be prior art).

*Primary Examiner*—William P. Neuder

*Attorney, Agent, or Firm*—Tracy W. Druce; Lucian Wayne Beavers

[57] ABSTRACT

Methods of perforating a well using coiled tubing conveyed perforating guns are disclosed. A perforating tool string includes a coiled tubing string, a perforating gun, a releasable gun hanger, and a pressure responsive release connecting the coiled tubing string to the perforating gun. The perforating tool string is lowered into place within the well and then the gun hanger is actuated by reciprocating motion of the coiled tubing string without rotating the coiled tubing string, thereby setting the gun hanger in the casing. Fluid pressure is then increased in the coiled tubing string to actuate the pressure responsive release to release the coiled tubing string from the perforating gun. The coiled tubing string and pressure responsive connector may then be retrieved from the well prior to firing the perforating gun. The perforating gun is subsequently fired by a pressure responsive firing head to perforate the well casing, and the perforating gun then automatically drops to the bottom of the well casing.

18 Claims, 8 Drawing Sheets

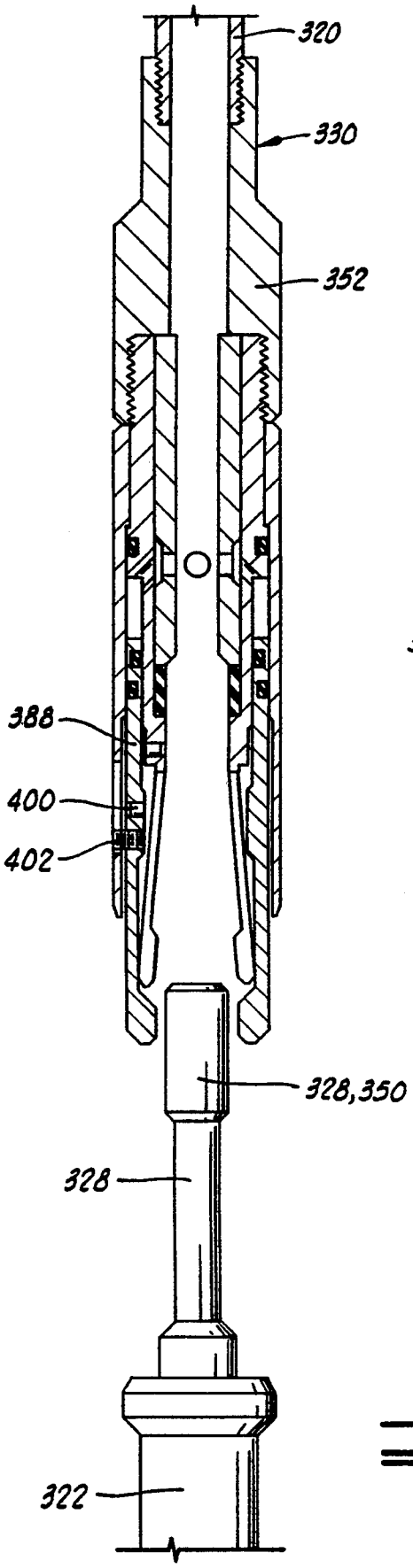
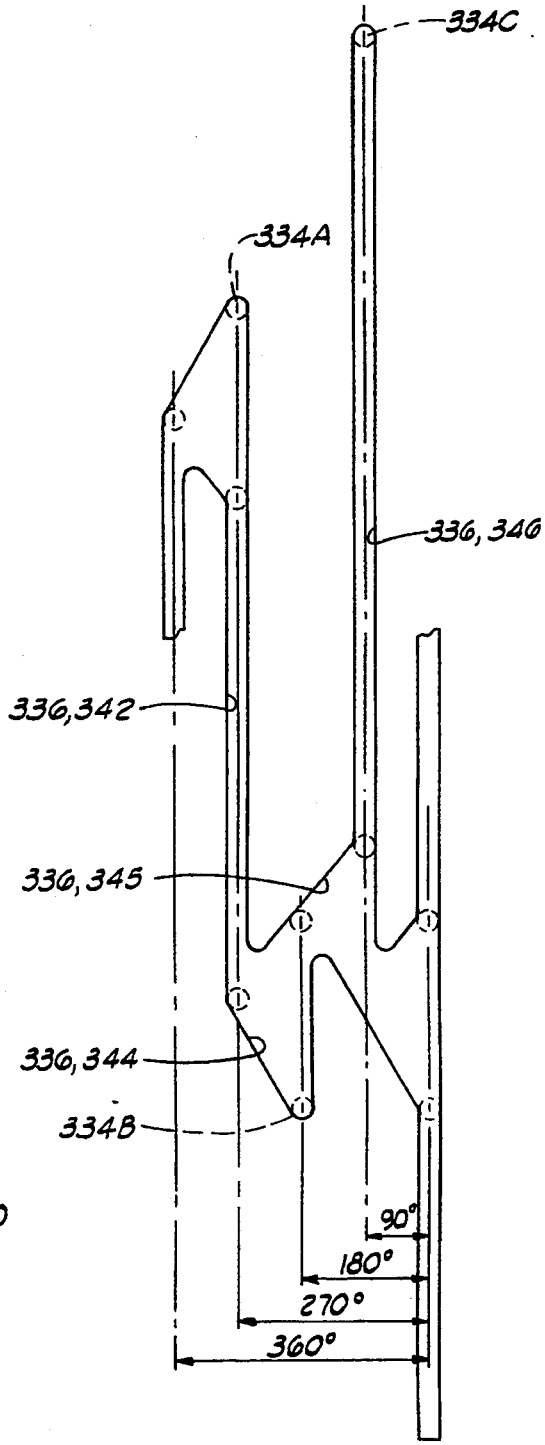
FIG. 11
FIG. 10

METHODS OF PERFORATING A WELL USING COILED TUBING

BACKGROUND OF THE INVENTION

1. Field Of The Invention

The present invention relates generally to methods for perforating a well utilizing perforating guns conveyed into the well on a coiled tubing string.

2. Description Of The Prior Art

In the past, tubing conveyed perforating systems for use in completing wells have been conveyed into the wells on a tubing or pipe string with the string left in position in the well during the perforating of the well. After perforating of the well, the perforating guns may have disintegrated or may be retrieved, or may be released or dropped from the tubing or pipe string through the use of various techniques.

More recently, an automatically releasing gun hanger has been proposed as shown in U.S. Pat. No. 5,156,213 to George et al., and assigned to the assignee of the present invention. The George et al. '213 patent describes an automatically releasing gun hanger which is run into the well on a rigid tubing string or pipe string. The gun hanger is set within the well by a rotating motion of the rigid tubing string or pipe string. The rigid tubing string or pipe string is then disconnected from the guns attached to the gun hanger through further rotational motion. The pipe string can then be removed from the well. The perforating gun is fired by a pressure actuated firing head and upon firing of the perforating gun, the gun hanger automatically releases thus allowing the guns to drop to the bottom of the well and leaving an unobstructed flow path from the perforations up through the well bore.

While there are many advantages from using an automatically releasable gun hanger such as shown in the George et al. '213 patent, that automatically releasing gun hanger is not suitable for use on a coiled tubing string due to the fact that rotational motion is required to set the gun hanger and to subsequently release the tubing string from the gun hanger of the George et al. '213 patent.

SUMMARY OF THE INVENTION

The present invention provides a modified version of a releasable gun hanger apparatus like that of the George et al. '213 patent which is suitable for use with a coiled tubing string.

This is accomplished by modifying the actuating mechanism of the gun hanger so that it is operated by simple reciprocating motion of the tubing string without the need for any rotating motion. Also, a pressure responsive release mechanism connects the coiled tubing string to the perforating gun so that after the gun hanger has been set within the casing, pressure within the coiled tubing string may be increased to release the coiled tubing string from the perforating gun thus allowing the coiled tubing string to be retrieved prior to firing of the perforating guns.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIGS. 8, 9 and 10 comprise a sequential series of elevation sectioned views of the pressure operated release mechanism and the upper end of the perforating gun assembly of either FIG. 5 or FIG. 6.

FIG. 11 is a laid-out view of a portion of the automatic J-slot and lug assembly of the modified casing hanger utilized with the systems of FIGS. 5–7.

DETAILED DESCRIPTION OF THE PREFERRED EMBODIMENTS

Description Of The Prior Art Apparatus Of FIGS. 1–4

Figure 1:
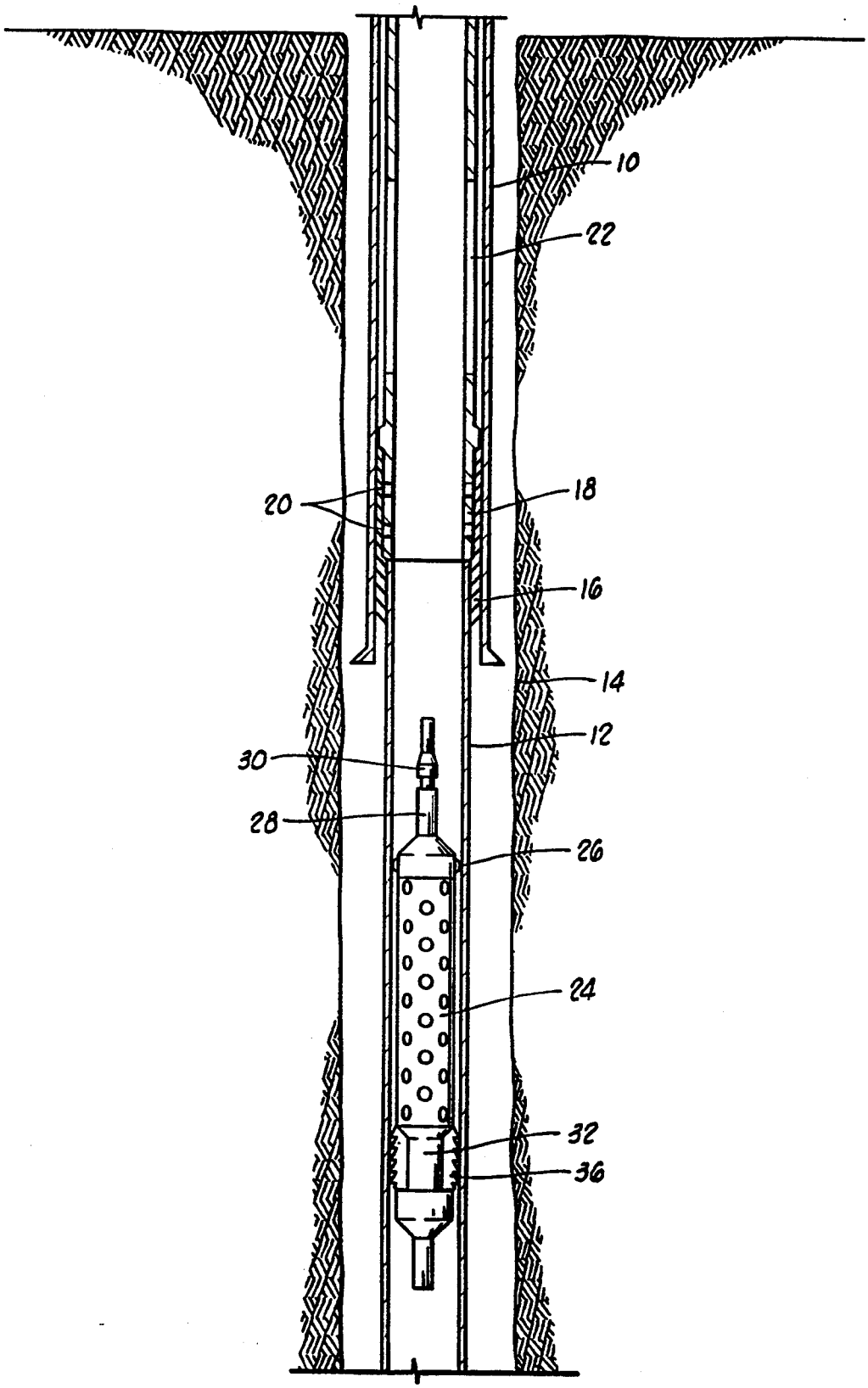
FIG. 1 (PRIOR ART)
FIG. 1 is an elevation schematic view of the prior art system of the George et al. U.S. Pat. No. 5,156,213 patent showing an automatic releasing gun hanger in place within a well liner. The gun hanger is of the type which is set and subsequently released by rotational motion of a rigid pipe string.

Referring to FIG. 1, a monobore completion system is shown where the well is completed using a tubing conveyed perforating completion system having a releasable gun hanger for the tubing conveyed perforating guns.

A well casing 10 having a liner 12 is shown in a well bore 14. The casing 10 and liner 12 are typically cemented in the well bore 14. Installed on the upper end of the liner 12 is a polished bore receptacle 16. The polished bore receptacle 16 may be of any suitable type, such as sold by Otis Engineering Corporation, Dallas, Tex. Additionally, the polished bore receptacle may be either installed on the upper end of the liner 12 or the lower end of the casing 10.

Engaging the polished bore of receptacle 16 is a tie-back seal assembly 18 having a plurality of seals 20 thereon, the tie-back seal assembly 18 being connected to the lower end of production pipe string 22. The tie-back seal assembly 18 may be of any suitable type such as sold by Otis Engineering Corporation, Dallas, Tex.

Further shown in FIG. 1 is a tubing conveyed perforating gun assembly 24 having a centralizer 26 thereon to centralize the perforating gun assembly 24 in the liner 12, a firing head 28 thereon, an on-off mandrel 30 on the upper end of the firing head 28, and a releasable gun hanger 32 connected to the lower end thereof. The on-off mandrel 30 may be of any suitable type which is capable of mating with a suitable on-off shoe (not shown) attached to the end of either a drill pipe work string (not shown) or tubing string (not shown) which is used to run the perforating gun assembly 24 having releasable gun hanger 32 thereon into the liner 12 to the desired location at which time, the perforating gun assembly 24 is installed in the liner 12 and the drill pipe work string or tubing string is disconnected from the perforating gun assembly 24 and removed from the well.

The firing head 28 on the perforating gun assembly 24 may be of any suitable type, such as described in U.S. Pat. No. 4,614,156.

Figure 2:
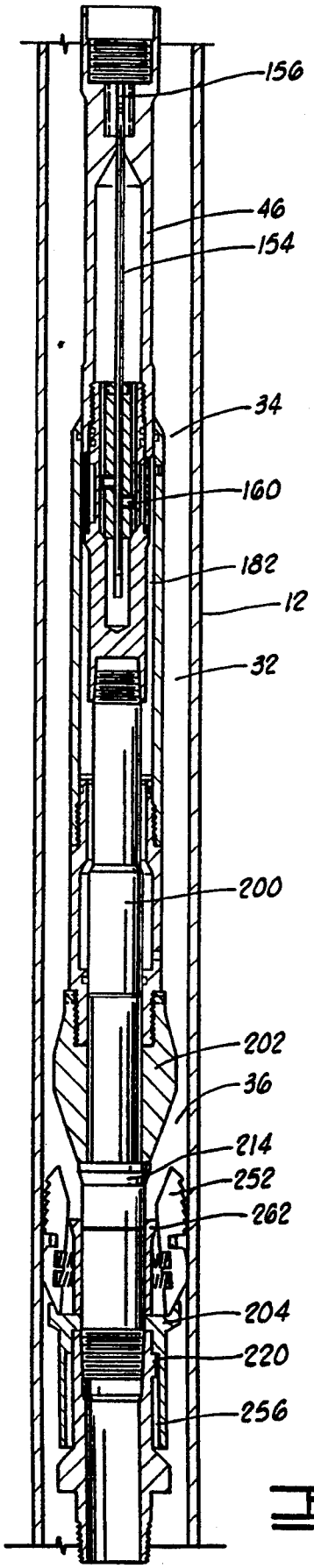
FIG. 2 (PRIOR ART)
FIGS. 2, 3 and 4 are enlarged elevational views of the prior art releasable gun hanger of the George et al. U.S. Pat. No. 5,156,213 patent.

Referring to FIG. 2, the releasable gun hanger 32 is shown in the liner 12.

The releasable gun hanger 32 comprises an automatic gun release section 34 and support section 36. As shown in FIG. 2, the releasable gun hanger 32 has the support section 36 in its locked running position for running through the liner 12.

Figure 3:
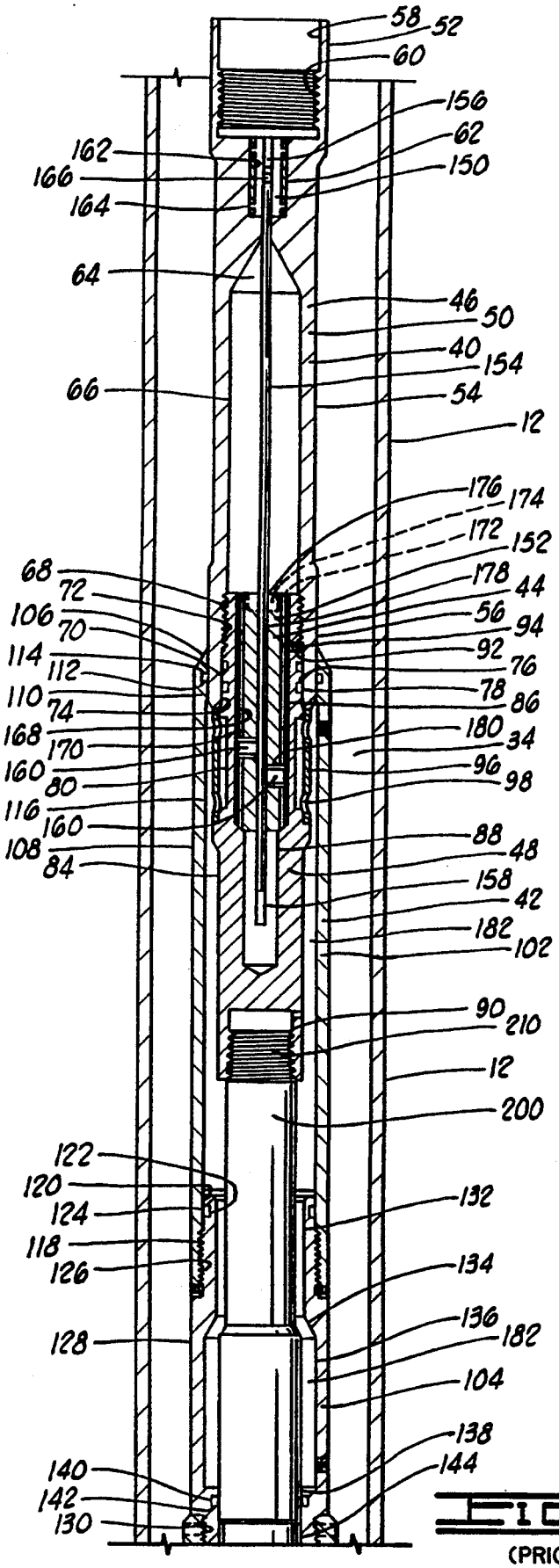
FIG. 3 (PRIOR ART)

Referring to FIG. 3, the automatic gun release section 34 is shown. The automatic gun release section 34 comprises a mandrel assembly 40, housing assembly 42 and explosive charge carrier assembly 44.

The mandrel assembly 40 comprises upper mandrel 46 and charge carrier mandrel 48. The upper mandrel 46 comprises an elongated annular cylindrical member having, on the exterior thereof, first cylindrical surface 52, second cylindrical surface 54 and third cylindrical surface 56 and having, on the interior thereof, first bore 58, first threaded bore 60, second bore 62, frusto-conical bore 64, third bore 66, second threaded bore 68 and fourth bore 70. Charge carrier mandrel 48 comprises an elongated annular cylindrical member having, on the exterior thereof, threaded surface 72 which threadedly engages second threaded bore 68 of upper mandrel 46, first cylindrical surface 74 having, in turn, a plurality of annular recesses 76 therein containing annular elastomeric seal means 78 therein which sealingly engage fourth bore 70 of upper mandrel 46, annular recess 80 therein, third cylindrical surface 84 and having, on the interior thereof, first bore 86, blind bore 88 and threaded recess 90 on the end thereof. The charge carrier mandrel 48 further includes threaded aperture 92 having, in turn, set screw 94 therein and spacer sleeve 96, located on first cylindrical surface 74 of mandrel 48 and having, in turn, a plurality of apertures 98 therein.

The charge carrier mandrel 48 is threadedly connected at its lower end to the upper end of support mandrel 200.

The housing assembly 42 comprises upper housing 102 and lower housing 104. The upper housing 102 comprises an elongated annular cylindrical member having, on the exterior thereof, frusto-conical surface 106 and cylindrical surface 108 and having, on the interior thereof, first bore 110 having, in turn, annular recess 112 therein containing annular elastomeric seal means 114 therein, which, in turn, slidingly, sealing engage third cylindrical surface 56 of upper mandrel 46, second bore 116 and threaded bore 118.

Figure 4:
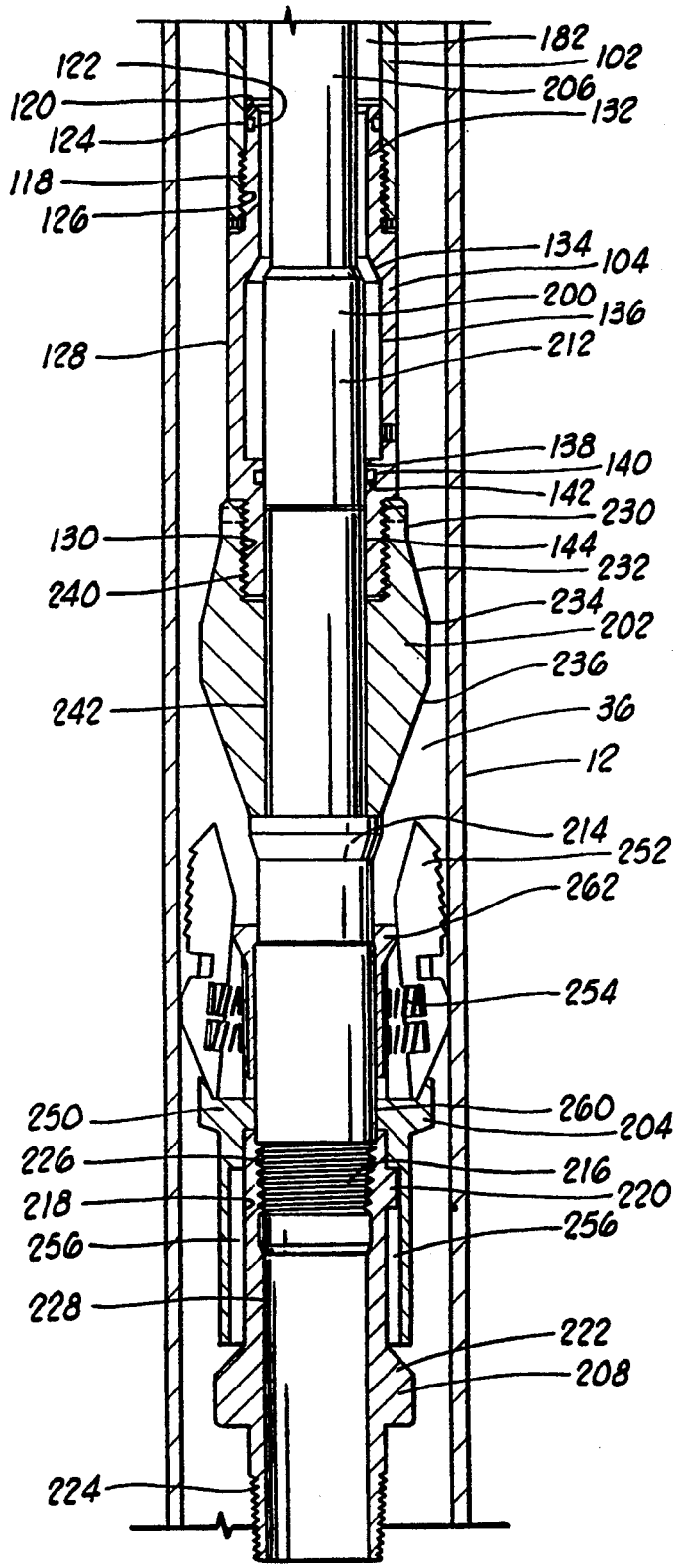
FIG. 4 (PRIOR ART)

Referring to FIGS. 3 and 4, lower housing 104 comprises an elongated annular cylindrical member having, on the exterior thereof, first cylindrical surface 120 having, in turn, annular recess 122 containing annular elastomeric seal means 124 therein which, in turn, sealingly engage a portion of second bore 116 of upper housing 102, first threaded surface 126 which threadedly engages threaded bore 118 of upper housing 102, second cylindrical surface 128 and second threaded surface 130 and having, on the interior thereof, first bore 132, frusto-conical surface 134, second bore 136, third bore 138 having, in turn, annular recess 140 containing annular elastomeric seal means 142 therein, and fourth bore 144.

Referring again to FIG. 3, the explosive charge carrier assembly 44 comprises booster holder 150, charge carrier 152, detonating cord 154 having booster 156 on one end thereof and end seal 158 on the other end thereof, and a plurality of shaped explosive charges 160.

The booster holder 150 which is retained within second bore 62 of upper mandrel 46 comprises an annular cylindrical member having a cylindrical exterior surface 162 having annular lugs 164 thereon and bore 166 therethrough through which detonating cord 154 extends. Charge carrier 152 which is retained within first bore 86 of charge carrier mandrel 48 comprises an elongated annular cylindrical member having cylindrical exterior surface 168 having, in turn, fluid relief grooves 170 therein and having, on the interior thereof, threaded bore 172, threaded plug 174 therein having, in turn, bore 176 therein to receive the detonating cord 154 therethrough, bore 178 through which detonating cord 154 extends and a plurality of apertures 180 in which shaped explosive charges 160 are received. The charge carrier 152 is retained within charge carrier mandrel 48 by set screw 94 engaging exterior surface 168 of the carrier 152.

When assembled, the annular cavity 182 between the mandrel assembly 40 and housing assembly 42 is filled with suitable oil, such as silicon oil, to prevent substantial movement of the releasable gun hanger until actuated.

Referring to FIG. 4, the support section 36 is shown. The support section 36 comprises support mandrel 200, slip wedge 202, and J-slot and slip assembly 204.

The support mandrel 200 comprises upper support mandrel 206 and slip mandrel 208. The upper support mandrel 206 comprises an elongated cylindrical member having an upper threaded end 210 (see FIG. 3) which threadedly engages threaded recess 90 of charge carrier mandrel 48, cylindrical seal section 212 which slidingly, sealingly engages annular elastomeric seal means 142 of lower housing 104 to seal the lower end of annular oil filled cavity 182, annular slip wedge abutment 214 and lower threaded end 216. The slip mandrel 208 comprises an elongated annular cylindrical member having, on the exterior thereof, cylindrical surface 218, J-slot lug 220, frusto-conical annular wedge 222, and threaded lower surface 224 and having, on the interior thereof, threaded bore 226 which threadedly engages lower threaded end 216 of upper support mandrel 206 and bore 228. The slip wedge 202 comprises an annular cylindrical member having, on the exterior thereof, first cylindrical surface 230, first frusto-conical annular surface 232, second cylindrical surface 234, and second frusto-conical annular slip surface 236 and having, on the interior thereof, threaded bore 240 which threadedly engages second threaded surface 130 of lower housing 104 and bore 242 through which a portion of upper support mandrel 206 extends. The J-slot and slip assembly 204 comprises a slip retainer housing 250 having, in turn, a plurality of cantilevered slips 252 resiliently mounted thereon by means of springs 254 which also bias the slips 252 against liner 12 and a conventional J-slot 256 in which the J-slot lug 220 on slip mandrel 208 moves to allow the setting of the releasable gun hanger 32 in the liner 12. The J-slot and slip housing 250 includes a central bore 260 and frusto-conical annular abutment surface 262.

The J-slot and slip assembly 204 and slip mandrel 208 can be of any conventional, commercially available type, such as sold by Baker Hughes, Inc., Houston, Tex.

Referring to FIG. 1, the perforating system and method of completing wells will be described.

The well bore is drilled and has the casing 10 and liner 12 typically cemented therein having either the liner 12 or casing 10 having, in turn, the polished bore receptacle 16 installed thereon. The production pipe string 22 having the seal assembly 18 on the end thereof is run into the casing 10 with the seal assembly 18 being installed in the polished bore receptacle 16 thereby preparing the well to be completed by perforating and to be immediately placed on production.

Subsequent to the production pipe string 22 being run into the well, the perforating gun 24 having the releasable gun hanger 32 connected thereto is run into the liner 12 with the support section 36 being actuated to support the perforating gun 24 in the liner 12. At this time, the tubing string is disconnected from the perforating gun 24 at the on-off connector 30 and pulled from the well.

At this point, the well has the production pipe string 22 installed therein, is ready for production, and the perforating gun 24 supported in the liner 12 at the desired point so that the perforating gun 24 may be actuated to perforate the liner 12, the cement sheath surrounding the liner 12 and the surrounding formation to be produced through the liner 12 and production pipe string 22.

It should be understood that, if desired, the perforating gun 24 and releasable gun hanger 32 may be installed in the liner 12 prior to the time the production pipe string 22 having seal assembly 18 on one end thereof is installed in polished bore receptacle 16. Also, the perforating gun 24 either may be located by any suitable method in the liner 12, or may comprise any number of perforating guns from one to eighty (80) or more.

Referring to FIGS. 1 and 2, the operation of the releasable gun hanger 32 will be set forth. The releasable gun hanger 32 is connected to the perforating gun bottom end tandem by threading upper mandrel 46 thereto. In this manner, the booster 156 connected to the end of the detonating cord 154 will be adjacent the booster in the tandem on the bottom of the perforating gun to be actuated thereby.

To set the releasable gun hanger 32, it is necessary to unlock the J-lug 220 on slip mandrel 208 from the short leg of the J-slot 256 in the J-slot and slip assembly 204. To unlock the J-lug 220, weight is picked up from the tubing string, perforating gun 24 and release and support 36 while a right-hand torque is applied to the string. This causes relative movement between the J-slot and slip assembly 204 and the slip mandrel 208 as slips 252 remain biased into engagement with liner 12. After weight has been picked up from the tubing string, perforating gun 24 and release and support 36, right-hand torque is still applied to the tubing string, perforating gun 24 and release and support 36 to cause the J-lug 220 to move into the long leg of the J-slot 256 of the J-slot and slip assembly 204 with weight then being set down to cause the J-lug 220 to move through the long leg of the J-slot 256. When this occurs, since the release portion 34 is hydraulically locked due to the annular chamber 182 being oil filled, the slip wedge 202 is pushed downward into engagement with slips 252 to wedge the slips 252 into the liner 12 thereby allowing the weight of the tubing string, perforating gun 24 and releasable gun hanger 32 to be carried by the slips 252 and slip wedge 202. When the weight of the perforating gun 24 is being carried by the releasable gun hanger 32, the tubing string is disconnected from on-off connector 30 and removed from the well. At this time, the perforating gun 24 is ready to be actuated.

If a firing head 28 is a pressure activated time delay type, such as described in U.S. Pat. No. 4,614,156, the fluid pressure in the casing 10 and liner 12 is increased to actuated the firing head 28, then bled off to either a pressure level equal to the hydrostatic fluid pressure of the formation to be perforated, or a pressure level less than the hydrostatic fluid pressure of the formation to be perforated, or a pressure level greater than the hydrostatic fluid pressure of the formation to be perforated.

After actuation, the firing head 28 will cause detonation of the perforating charges in the perforating gun 24 and actuate the releasable gun hanger 32 to release the perforating gun 24 to drop to the bottom of the liner 12, the rat hole of the well.

Since the releasable gun hanger 32 is secured to the bottom tandem of the perforating gun 24, after the last perforating charge in the gun 24 has fired and the detonating cord has actuated the booster in the bottom tandem of the gun 24, the booster 156 and detonating cord 154 are actuated thereby causing shaped charges 160 to detonate rupturing charge carried mandrel 48 in a plurality of locations. Once charge carrier mandrel 48 has been perforated, oil from annular chamber 182 may flow into upper mandrel 46 and the charge carrier mandrel 48. The weight of the perforating gun 24 bearing down on upper mandrel 46 which is now free to move causes support mandrel 200 to move downwardly which, in turn, causes slip wedge abutment 214 to engage surface 262 of slip retainer housing 250 to push slips 252 downwardly off slip wedge 202 thereby releasing slips 252 from liner 12 allowing the perforating guns to be released and move downwardly through liner 12 to the bottom thereof, automatically.

Since the firing head 28 of the perforating gun 24 contains on-off connector 30 secured thereto, if desired, tubing having a mating on-off tool shoe thereon may be run into the well to retrieve the perforating gun 24 and releasable gun hanger 32 from the well.

Methods Of Perforating With Coiled Tubing

Figure 5:
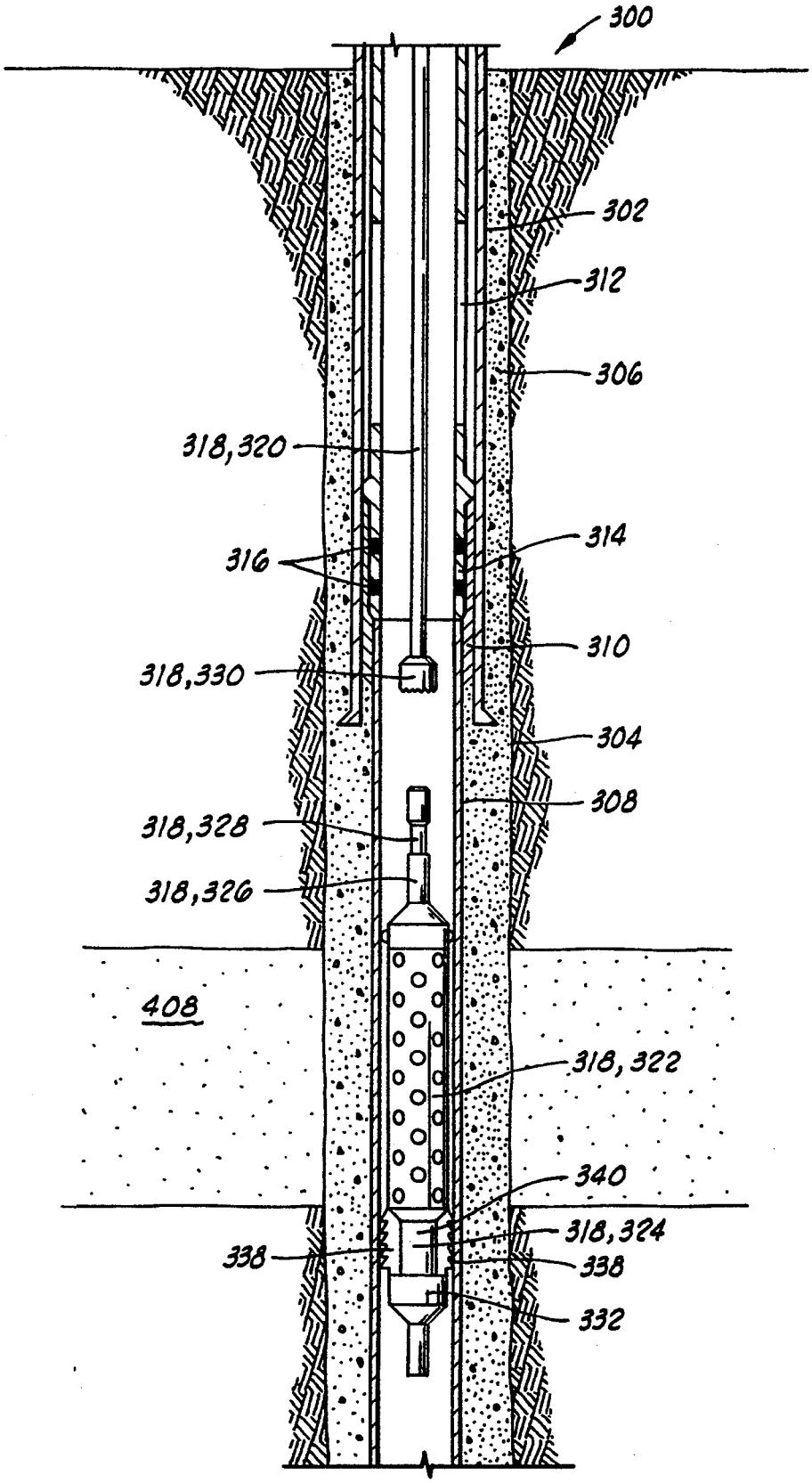
FIG. 5 is an elevation schematic sectioned view of a well using a monobore completion and using the coiled tubing conveyed perforating system of the present invention.

FIG. 5 is an elevation, schematic, sectioned illustration illustrating the coiled tubing conveyed and actuated perforating system of the present invention utilized in a well having a monobore completion system.

A well 300 is shown having a casing 302 cemented in place within a well bore 304 by cement 306. A liner 308 which is simply a lower, smaller diameter casing string extends downward from the upper casing 302. A polished bore receptacle 310 is defined in the lower end of casing 302.

A production tubing string 312 carries tie-back seal assembly 314 which includes seals 316 and which is sealingly received within the polished bore receptacle 310.

A perforating tool string 318 is shown in place within the well. The perforating tool string 318 includes a coiled tubing string 320, one or more perforating guns 322, a releasable gun hanger 324, a pressure actuated firing head 326, a firing head extension 328, and a pressure responsive release mechanism 330.

The perforating tool string 318 is initially all connected together by connection of the pressure responsive release 330 to the firing head extension 328 in the manner illustrated in FIG. 8 and further described below.

In FIG. 5, the releasable gun hanger 324 has been set within the liner 308 and the pressure responsive release 330 has been disconnected from firing head extension 328 and the coiled tubing string 320 and pressure responsive release 330 are in the process of being pulled upward out of the well.

The releasable gun hanger 324 is in most aspects identical to the releasable gun hanger 32 of FIGS. 3 and 4. There are two major changes, namely modification of the J-slot and slip assembly 204 of FIG. 4 to provide an automatic J-slot and slip assembly 332 schematically illustrated in FIG. 5.

The lug and J-slot of the automatic J-slot and slip assembly 332 are schematically illustrated in FIG. 11 in a laid-out view. The lug and J-slot of the automatic J-slot and slip assembly of FIG. 11 are modified considerably as compared to the lug 220 and J-slot 254 shown in FIG. 4. The location of the lug and J-slot have been reversed. In the embodiment of FIG. 11, a lug 334 extends radially inward from an outer sleeve attached to the slips 252 and a J-slot 336 is defined in the outer surface of the slip mandrel 208 and has the lug 334 received therein. A lug 334 is represented in several positions in FIG. 11.

The automatic J-slot arrangement of FIG. 11 is constructed to actuate the slips 338 of gun hanger 324 in response to purely reciprocable motion of coiled tubing string 318 without the need for any application of rotational motion to any of the apparatus by the coiled tubing string 320. This is contrasted to the prior art arrangement of FIGS. 1–4 wherein rotating motion is required to move the lug 220 through the J-slot 256.

For example, when the perforating tool string 318 is initially being run into the well 300, the slips 338 drag against the liner 308 due to the action of springs like the springs 254 of FIG. 4 and the downward forces being transmitted through the inner mandrel 340 will cause the lug 334 to be found in position 334A in the upper end of a short leg portion 342 of J-slot 336.

When it is desired to set the slips 338, weight is picked up from the coiled tubing string 320 thus causing the lug 334 to move downward through the short leg 342, then to move diagonally through the sloped portion 344 into the lower end thereof to the position designated as 334B. Then upon setting weight back down on coiled tubing string 320, the lug 334 moves up through a sloped portion 345 and up through a long leg portion 346 to an uppermost position 334C. This longitudinal motion upward through the long groove portion 346 allows the slip wedge like slip wedge 202 to cam the slips 338 radially outward to thus set the releasable gun hanger 332 within the liner 308.

It will be appreciated that the J-slot 336 or lug 334 may be constructed in an annular ring which is mounted on bearings so that it may rotate within the housing of the releasable gun hanger 32 as the lug 334 reciprocates up and down relative to the J-slot 336.

Generally, the short leg portion 342 and long leg portion 346 of J-slot 336 can be described as first and second longitudinal slot portions 342 and 346, and the sloped portion 345 can be described as a sloped slot portion 344.

The other aspect of the releasable gun hanger 324 which has been modified as compared to the prior art releasable gun hanger 32 of FIGS. 1–4 is that the on-off mandrel 30 has been replaced by a firing head extension or stinger 328 which is associated with a pressure responsive release 330 which connects the coiled tubing string 320 to the stinger 328 and thus to the perforating guns 322 and the releasable gun hanger 324.

Figure 8:
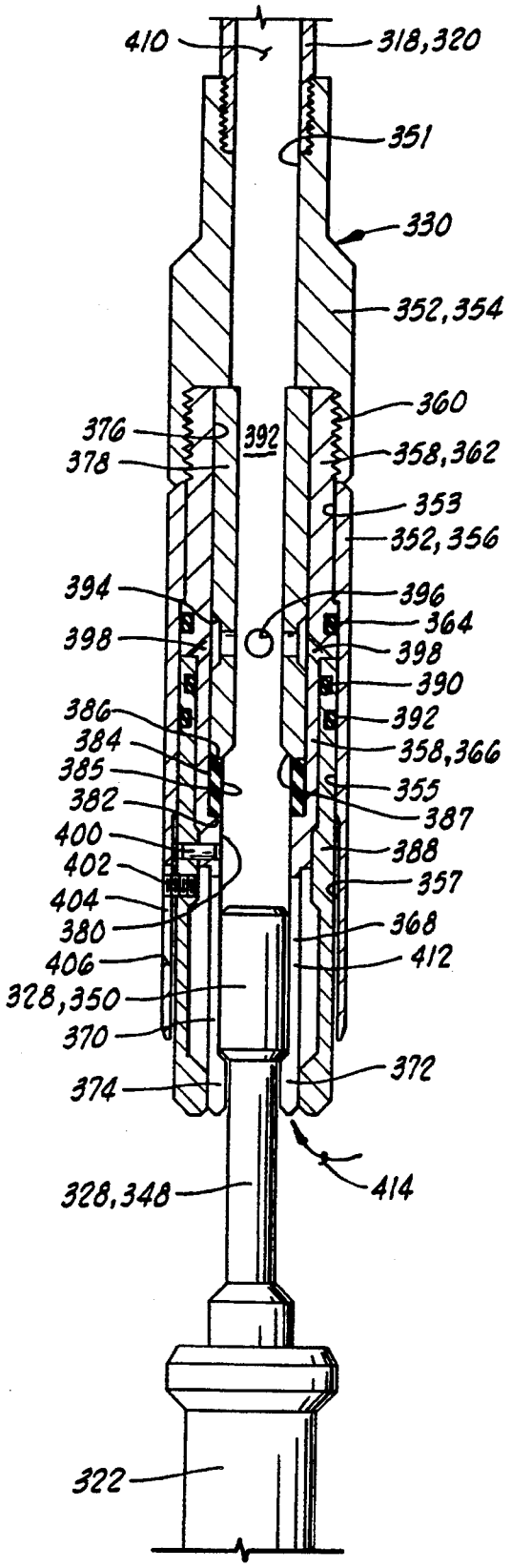
Figure 9:
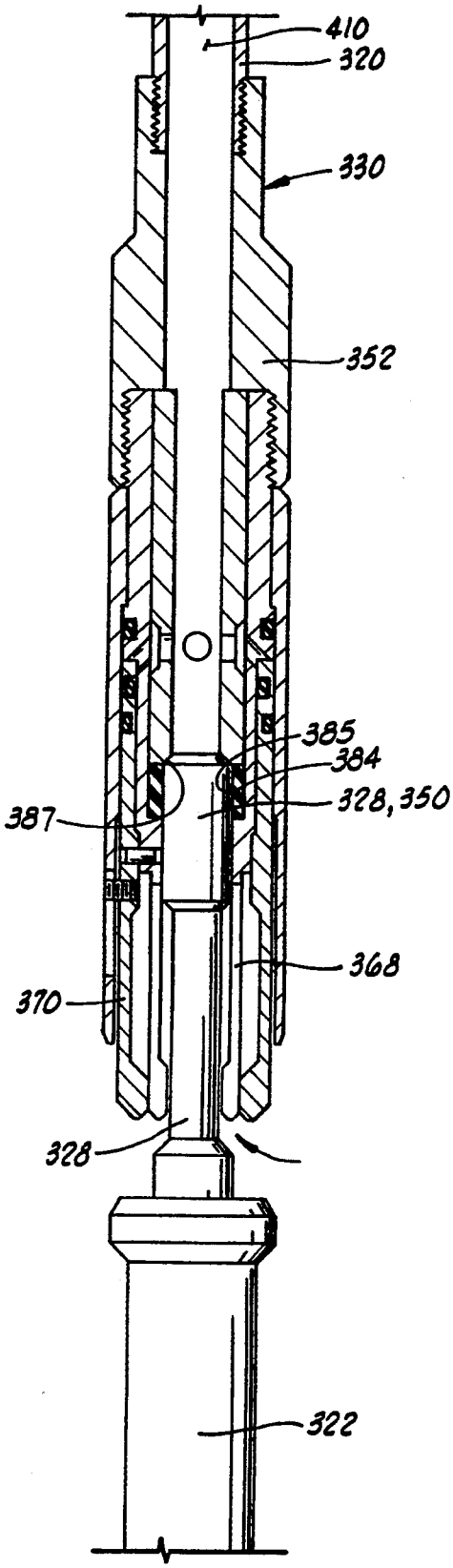

The details of construction of the stinger 328 and of the pressure responsive release 330 are best seen in FIGS. 8–10.

The stinger 328 includes a fishing neck 348 having an enlarged diameter head 350 on the upper end thereof.

The pressure responsive release 330 includes an outer housing 352 having upper housing portion 354 and lower housing portion 356 which are fixedly attached to each other.

The outer housing 352 has an upper bore 351, a first counterbore 353, a second counterbore 355, and a lowermost third counterbore 357.

A collet assembly 358 is received in housing 352 and is fixedly connected thereto at threaded connection 360 near the upper end of collet assembly 358. The collet assembly 358 includes an upper cylindrical portion 362 which is closely received within the counterbore 353 of housing 352.

Upper cylindrical portion 362 of collet assembly 358 has a groove defined therein which carries an O-ring seal 364 which seals against the second counterbore 355 of outer housing assembly 352.

Collet assembly 358 includes an intermediate necked down reduced diameter portion 366 located below upper portion 362.

Extending downward from reduced diameter portion 366 are a plurality of collet fingers such as 368 and 370 having enlarged radially inward extending collet heads or shoulders such as 372 and 374, respectively, defined thereon.

Collet assembly 358 includes an upper inner bore 376 within which is received a seal retaining sleeve 378. Collet assembly 358 further includes a reduced diameter lower bore 380 joined to upper bore 376 by an upward facing annular shoulder 382. An annular elastomeric sealing sleeve 384 is received in the lower end of bore 376 and abuts shoulder 382. The sealing sleeve 384 is sandwiched between the shoulder 382 and a lower end 386 of seal retaining sleeve 378.

An annular cavity is defined between the reduced diameter intermediate portion 366 of collet assembly 358 on the inside and the lower housing 356 on the outside. Within this annular chamber there is received a collet retaining sleeve 388. The collet retaining sleeve 388 carries an inner O-ring seal 390 which seals against the outer cylindrical surface of reduced diameter portion 366 of collet assembly 358. The collet retaining sleeve 388 carries an outer O-ring seal 392 which seals against the second counterbore 355 of lower housing 356.

The upper bore 351 of housing 352 is communicated with a central bore 392 defined through collet retaining sleeve 388. Seal retaining sleeve 378 includes an annular recess 394 defined in the outer surface thereof, which is communicated with the bore 392 through a plurality of ports 396. The annular recess 394 in turn communicates with a plurality of angularly oriented passages 398 defined in collet assembly 358 and communicated with the upper end of collet retaining sleeve 388.

The collet retaining sleeve 388 may also be described as a differential pressure actuating piston or releasing piston 388 having piston rings 390 and 392.

The collet retaining sleeve 388 is initially held in position relative to the collet assembly 358 and housing 352 by one or more shear pins 400.

The collet retaining sleeve 388 also carries a lug 402 which extends radially outward therefrom through a longitudinal slot 404 defined in the lower housing 356. As is further described below, downward movement of collet retaining sleeve 388 relative to housing 352 will be limited by abutment of lug 402 on a lower end 406 of slot 404.

Operation Of The Embodiment Of FIG. 5

The casing liner 308 of the well 300 illustrated in FIG. 5 may be perforated using the perforating tool string 318 in the following manner.

Most often, the production tubing string 312 with its tie-back seal assembly 314 will be placed within the well as illustrated in FIG. 5 prior to placing the perforating tool string 318 in the well 300. It will be understood, however, that the perforating string 318 may be placed in the well in the manner described below prior to placement of the production tubing string within the well.

The perforating tool string 318 is initially all connected together and the pressure responsive release 330 is connected to the stinger 328 as shown in FIG. 8. The collet fingers 368 and 370 are located closely against enlarged head 350 with the collet heads 372 and 374 being located below the enlarged head 350 of stinger 328. The collet fingers 368 and 370 are held in this position by the collet retaining sleeve 388 which is initially held in its position by shear pins 400.

The stinger 328 is slidable within the pressure responsive release 330 between a lower open position as seen in FIG. 8 and an upper closed position as seen in FIG. 9.

When in the lower open position of FIG. 8, it will be appreciated that fluid can flow through the bore 410 of coiled tubing string 320 and down through the bore 392 and through slots 412 between adjacent ones of the collet fingers such as 370 and 372, and fluid can of course flow into the coiled tubing string 320 through the same path. Thus, as the coiled tubing string 320 is run into the well with the stinger 348 in the position shown in FIG. 8, well fluid can enter through the slot 412 up into the coiled tubing bore 410 as shown by the arrow 414.

The perforating tool string 318 is lowered into the upper casing 302 and the lower casing or liner 308 until the perforating gun 322 is adjacent a subsurface formation 408 which is to be perforated.

Then the gun hanger 324 is actuated by reciprocating motion of the coiled tubing string 320 without rotating the coiled tubing string 320, thereby setting the gun hanger 324 within the liner 308. This actuating motion is performed as previously described with regard to FIG. 11. Weight is picked up on the coiled tubing string 320 thus causing the lug 334 to move from position 334A to 334B. Weight is then set back down on the coiled tubing string 320 causing the lug to move from position 334B to position 334C thus causing the slips 338 to be cammed outward into a tight engagement with the liner 308. This is accomplished purely by picking up and setting down on the coiled tubing string 320 and there is no need for any rotation of the coiled tubing string 320.

After the releasable gun hanger 324 has been set within the liner 308, it is preferable to disconnect the coiled tubing string 320 therefrom and remove the coiled tubing string 320 from the well 300 prior to firing of the perforating gun 322. One purpose of this is to prevent damage to the coiled tubing string 320 from the shock waves created by firing of the perforating gun 322. Another advantage is that the coiled tubing is retrieved before well pressure is encountered in the well after perforation. The coiled tubing string 320 is released or disconnected from the perforating guns 322 in the following manner.

Referring now to FIGS. 8 and 9, to release the coiled tubing string 320 from the perforating guns 322, weight is set down on the coiled tubing string 320 to move the outer housing 352 and the collet fingers 368 and 370 downward relative to stinger 348 to a position shown in FIG. 9 wherein the enlarged head 350 of stinger 328 abuts a downward facing tapered surface 387 of seal retaining sleeve 378 and is closely sealingly received within a bore 385 of elastomeric sealing sleeve 384. This can be described as a closed position of the stinger 328 relative to the pressure responsive release 330. Surface 387 can be described as an annular valve seat 387, and the upper end of enlarged head 350 can be described as a valve closure surface; collectively the valve seat 387 and upper end of head 350 can be described as a closeable fill-up valve means. Subsequently, pressure within the bore 410 of coiled tubing string 320 is increased and that pressure is communicated to the upper end of collet retaining sleeve 388 through ports 396, annular recess 394 and ports 398. When a sufficient downward force is exerted upon collet retaining sleeve 388 by this internal pressure within the bore of coiled tubing string 320, the shear pin 400 will shear and collet retaining sleeve 388 will move downward relative to housing 352 to the position of FIG. 10 wherein the collet fingers 370 and 372 are free to spring radially outward as shown thus releasing the enlarged head 350 of stinger 328.

Thus, the coiled tubing string 320 is released from the stinger 328 purely in response to pressure increase within the coiled tubing string 320 without any need for rotational motion of the coiled tubing string 320.

The coiled tubing string 320 may then be withdrawn as is illustrated in FIG. 5.

Subsequently, when it is desired to fire the perforating gun 322 to perforate the casing 308 adjacent subsurface formation 408, pressure within the production tubing string 312 is increased and that pressure is communicated therethrough to the firing head 326 which fires the perforating gun 322.

When the perforating gun 322 fires, it automatically releases as previously described with regard to FIGS. 1–4, and drops to the bottom of the well thus leaving the liner 308 unobstructed for flow of well fluids from the formation 408 up through the production tubing string 312.

Figure 6:
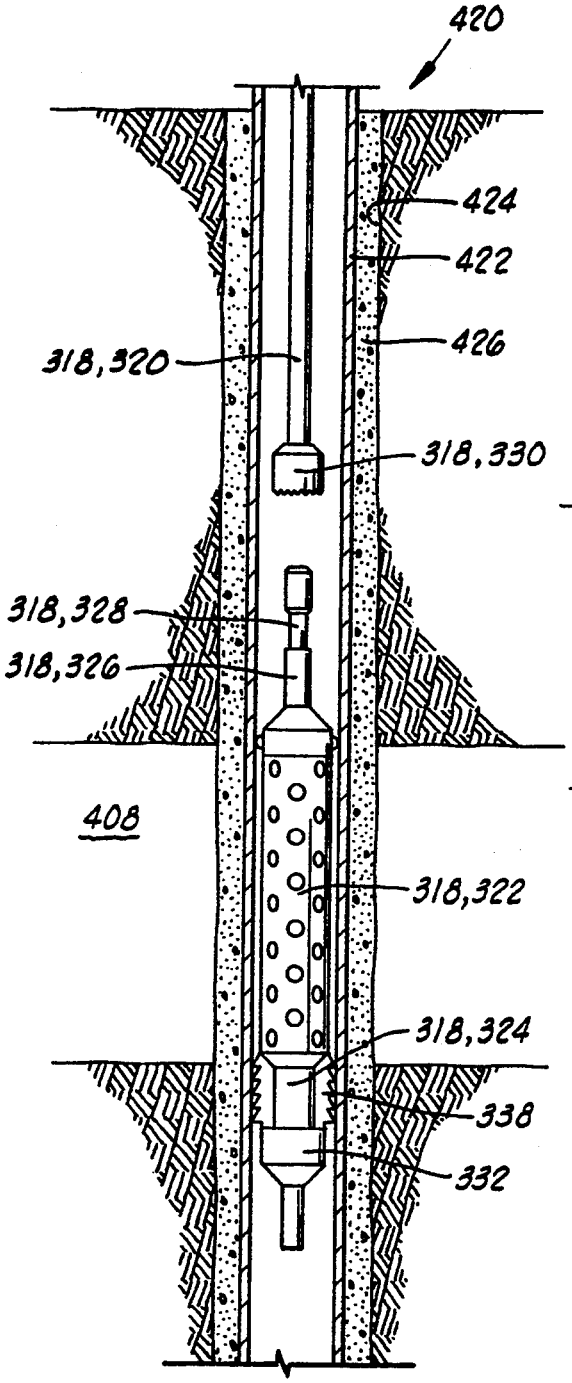
FIG. 6 is an elevation schematic sectioned view of an alternative version of the coiled tubing conveyed perforating system of the present invention in use in a well casing to be completed with conventional production tubing.
Figure 7:
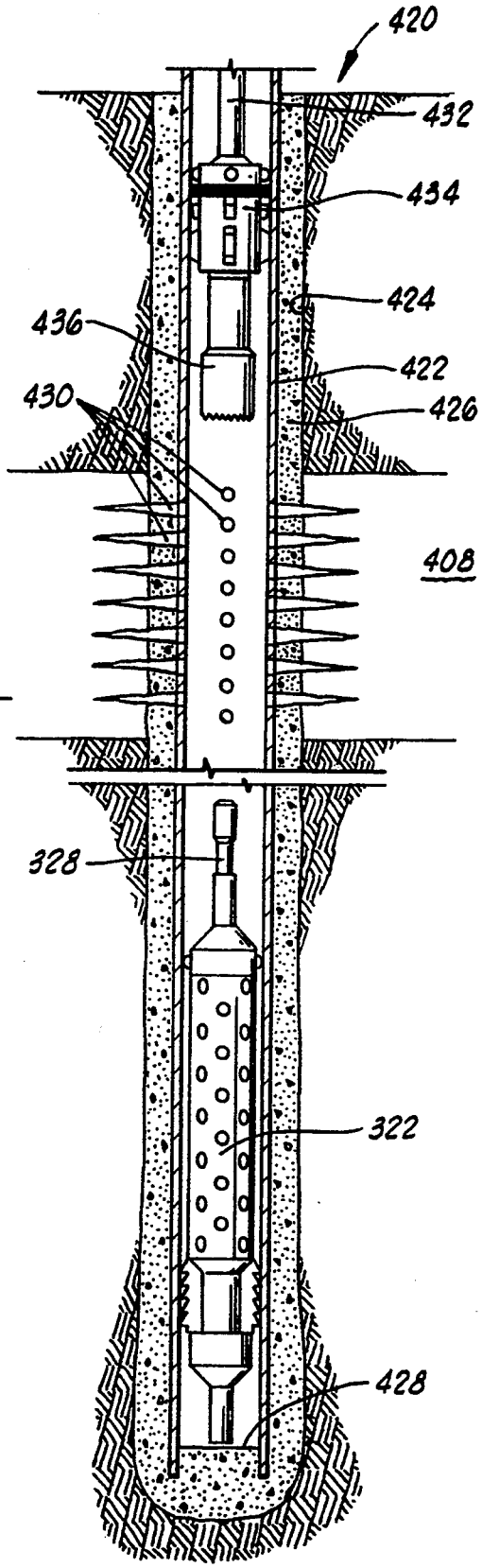
FIG. 7 is an elevation schematic sectioned view of the system of FIG. 6 after the perforating guns have fired and dropped into the bottom of the hole and after the coiled tubing string has been removed and a production tubing string and production tubing packer have been set in place within the casing bore.

The Alternative Embodiment Of FIGS. 6 And 7

FIGS. 6 and 7 are schematic, elevation, sectioned views somewhat similar to FIG. 5 illustrating an alternative method of perforating a well using coiled tubing and subsequently placing a conventional production tubing string and packer within the casing.

In FIG. 6, a well 420 is illustrated having conventional casing 422 cemented within a well bore 424 by cement 426. As seen in FIG. 7, the well 420 has a well bottom or rat hole 428.

The perforating tool string 318 illustrated in FIG. 6 is identical to the perforating tool string 318 previously described with regard to FIG. 5, and is also shown in the same position as shown in FIG. 5 wherein the releasable gun hanger 324 has been set in place and the pressure responsive release 330 has disconnected the coiled tubing string 320 from the stinger 328 so that the coiled tubing string 320 can be removed from the well 420.

Subsequently, the pressure within casing 422 is increased to fire the firing head 328 thus firing the perforating gun 322 to perforate the well casing 422 forming a plurality of perforations such as 430 therein as seen in FIG. 7.

The perforating gun 322 automatically drops to the bottom of the well 420 as seen in FIG. 7. This leaves an unobstructed flow path adjacent the perforations 430.

A production tubing string 432 carrying a conventional production packer 434 is lowered into place within casing 422 and set in place therein above the perforations 430 so that the formation 408 can be produced up through the production string 432.

Also in the embodiment of FIGS. 6–7, a drill stem test string could be run in place instead of the production tubing string and traditional drill stem tests could be conducted after perforation of the formation 408.

It will be appreciated that the production tubing string 432 and production packer 434 may also be run into place within the well to the position shown in FIG. 7 prior to firing of the perforating guns 332.

Also, the production tubing string 432 may carry a retrieving tool 436 on the lower end thereof which is constructed to engage the stinger 328 of perforating gun 322 to retrieve the perforating gun 322 from the well at any desired time. The perforating gun 322 could be retrieved prior to placing the well on production, or any time when the production tubing string 432 is to be pulled from the well. The production tubing string 432 may be lowered into position to engage the stinger 328 and pull the perforating guns 322 out with the production tubing string 432.

The retrieving tool 436 would be a slightly modified version of the pressure responsive release 330.

Thus it is seen that the present invention is readily adapted to achieve the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A method of perforating a casing of a well, comprising:

(a) providing a perforating tool string including:
- a coiled tubing string;
- a perforating gun;
- a releasable gun hanger connected to said perforating gun; and
- a releasable connector connecting said coiled tubing string to said perforating gun;

(b) lowering said perforating tool string into said casing until said perforating gun is adjacent a subsurface formation to be perforated;

(c) actuating said gun hanger and thereby setting said gun hanger in said casing;

(d) releasing said releasable connector from said perforating gun; and (e) firing said perforating gun and perforating said casing.

2. The method of claim 1, wherein:

in step (a) said releasable gun hanger is actuatable by reciprocating non-rotating motion, and said releasable connector is a pressure responsive releasable connector;

step (c) includes actuating said gun hanger by reciprocating motion of said coiled tubing string without rotating said coiled tubing string; and step (d) includes increasing fluid pressure in said coiled tubing string and thereby releasing said pressure responsive releasable connector from said perforating gun.

3. The method of claim 2, wherein:

in step (a) said perforating gun has a stinger extending upward therefrom and said stinger is received in said pressure responsive releasable connector and is slidable therein between a lower open position wherein a coiled tubing bore of said coiled tubing string is open and an upper closed position wherein said coiled tubing bore is closed; and said method further comprises between steps (c) and (d), setting down weight on said coiled tubing string to move said stinger to said upper closed position thereby closing said coiled tubing bore.

4. The method of claim 3, wherein:

step (d) includes applying said increased fluid pressure to a differential pressure piston in said pressure responsive releasable connector and moving said piston to release said pressure responsive releasable connector from said perforating gun.

5. The method of claim 3, further comprising:

during step (b), maintaining said stinger in said lower open position and filling said coiled tubing string with well fluid.

6. The method of claim 1, further comprising:

(f) between steps (d) and (e), retrieving said coiled tubing string and said releasable connector from said well before firing said perforating gun so that said coiled tubing string is not exposed to explosive forces generated by said perforating gun.

7. The method of claim 1, further comprising:

(f) releasing said gun hanger from said casing after firing of said perforating gun, and dropping said perforating gun and said releasable gun hanger to a bottom of said well.

8. The method of claim 1, wherein:

in step (a) said releasable gun hanger includes:
- a slip housing having a housing bore;
- a slip actuating mandrel reciprocably received in said housing bore; and
- a J-slot and lug assembly connecting said slip housing and said slip actuating mandrel, said J-slot and lug assembly including a J-slot having first and second longitudinal slot portions joined by a sloped slot portion; and step (c) includes moving said lug from said first longitudinal slot portion through said sloped slot portion to said second longitudinal slot portion in response to said reciprocating motion of said coiled tubing string without rotating said coiled tubing string.

9. The method of claim 1, wherein:

step (e) includes increasing a fluid pressure in said casing to actuate a pressure actuated firing head associated with said perforating gun.

10. The method of claim 1, further comprising:

(f) providing a monobore completion of said well including an upper casing of a first inner diameter, a lower liner of a second inner diameter smaller than said first inner diameter, a polished bore receptacle installed near an upper end of said liner, a production pipe string extending into said upper casing and having a lower end sealingly engaging said polished bore receptacle, said production pipe string having a third inner diameter substantially equal to said second inner diameter of said liner; and step (c) including setting said gun hanger in said liner.

11. The method of claim 10, wherein:

step (b) is performed after said production pipe string is installed in step (f).

12. The method of claim 1, further comprising:

(f) between steps (d) and (e), retrieving said coiled tubing string and said releasable connector from said well before firing said perforating gun so that said coiled tubing string is not exposed to explosive forces generated by said perforating gun; and (g) after step (f), running a production tubing string having a production packer into said casing and setting said production packer in said casing above said perforating gun.

13. The method of claim 12, wherein:

step (g) is performed before step (e).

14. A method of perforating a casing of a well, comprising:

(a) providing a perforating tool string including:

a coiled tubing string;

a perforating gun;

a releasable gun hanger connected to said perforating gun, said gun hanger being actuatable by reciprocating non-rotating motion; and a pressure responsive release connecting said coiled tubing string to said perforating gun;

(b) lowering said perforating tool string into said casing until said perforating gun is adjacent a subsurface formation to be perforated;

(c) actuating said gun hanger by reciprocating motion of said coiled tubing string without rotating said coiled tubing string, and thereby setting said gun hanger in said casing;

(d) increasing fluid pressure in said coiled tubing string and thereby releasing said pressure responsive release from said perforating gun;

(e) retrieving said coiled tubing string and said pressure responsive release from said well before firing said perforating gun so that said coiled tubing string is not exposed to explosive forces generated by said perforating gun;

(f) firing said perforating gun and perforating said casing; and (g) releasing said gun hanger from said casing after firing of said perforating gun, and dropping said perforating gun and said releasable gun hanger to a bottom of said well.

15. A pressure actuated release assembly for releasably connecting a tubing string to a well tool in a well, comprising:

a fishing neck adapted to be attached to said well tool and to extend upwardly from said well tool, said fishing neck having an enlarged head defined on an upper end thereof, said enlarged head having a valve closure surface defined thereon;

a housing having a housing bore, said housing including an upper connector means for connecting said housing to said tubing string so that said housing bore is communicated with a tubing bore of said tubing string, said housing having an annular valve seat defined therein, said enlarged head of said fishing neck being slidably received in said housing bore and slidable between an open position wherein said valve closure surface and said valve seat are spaced apart, and a closed position wherein said valve closure surface engages said valve seat to close said housing bore;

a releasable latch means connected to said housing and operably associated with said fishing neck for retaining said enlarged head in said housing bore when said latch means is in a latched position;

a hydraulic releasing piston communicated with said housing bore above said valve seat, and operably associated with said releasable latch means, said piston being movable from a first position corresponding to said latched position of said releasable latch means to a second position corresponding to an unlatched position of said releasable latch in response to an increase in fluid pressure in said tubing bore when said fishing neck is in its said closed position closing said housing bore.

16. The assembly of claim 15, wherein:

said open position of said enlarged head is a lower position thereof relative to said housing, and said tubing bore is in open fluid communication with an exterior of said housing when said enlarged head is in said lower open position so that said tubing string can fill with well fluid as said tubing string and well tool are run into said well.

17. The assembly of claim 15, wherein:

said releasable latch means is an annular collet having a plurality of downwardly extending collet fingers with radially inwardly extending collet shoulders thereon adapted to be received below said enlarged head of said fishing neck to retain said enlarged head in said housing bore.

18. A pressure actuated release apparatus for releasably connecting a tubing string to a well tool in a well, comprising:

a housing having a housing bore, said housing including a connection means for connecting said housing to said tubing string with said housing bore communicated with a tubing bore of said tubing string;

releasable latch means disposed in said housing for releasably latching said housing to said well tool;

an actuating piston means, disposed in said housing and communicated with said housing bore, for moving said latch means from a latched position to an unlatched position in response to an increase in fluid pressure in said tubing bore; and closeable fill-up valve means, disposed in said housing, for allowing said tubing bore to fill with well fluid as said tubing string and said well tool are run into said well, and for closing said tubing bore so that said actuating piston may be operated to unlatch said well tool after said well tool is run into said well, said closable fill-up valve means including an annular valve seat defined in said housing and surrounding said housing bore, and a closure valve surface defined on said well tool.

* * * * *